US005987831A

United States Patent [19]

Lamberts-Van Assche

[11] Patent Number: 5,987,831

[45] Date of Patent: Nov. 23, 1999

[54] BUILDING MATERIALS

[75] Inventor: Louis Lamberts-Van Assche, Loderzeel, Belgium

[73] Assignee: Marlux N.V., Tessenderlo, Belgium

[21] Appl. No.: 09/002,288

[22] Filed: Dec. 31, 1997

[30] Foreign Application Priority Data

Feb. 24, 1997 [GB] United Kingdom ..... 9703751

[51] Int. Cl.[6] ..... B44F 1/00

[52] U.S. Cl. ..... 52/316; 52/314; 52/311.1

[58] Field of Search ..... 359/567, 572; 428/163, 167; D25/58, 138, 149–163, 146–148; 52/316, 314, 311.1

[56] References Cited

U.S. PATENT DOCUMENTS

| | | | |
|---|---|---|---|
| 1,697,426 | 1/1929 | Humphreys et al. | 52/311.1 |
| 1,788,407 | 1/1931 | Prentis, Jr. | 52/311.1 |
| 1,877,481 | 9/1932 | Prouty | 52/311.1 |
| 2,069,720 | 2/1937 | Harvey | 52/311.1 |
| 3,338,730 | 8/1967 | Slade et al. | 359/567 |

FOREIGN PATENT DOCUMENTS

| | | |
|---|---|---|
| 0 399 959 A1 | 11/1990 | European Pat. Off. . |
| 0 414 896 A1 | 3/1991 | European Pat. Off. . |
| 0 425 670 A1 | 5/1991 | European Pat. Off. . |
| 7-188981 | 7/1995 | Japan . |
| 938087 | 2/1965 | United Kingdom . |
| 1 496 694 | 12/1977 | United Kingdom . |
| 2 134 147 | 8/1984 | United Kingdom . |
| 2 222 389 | 3/1990 | United Kingdom . |
| 2 237 587 | 5/1991 | United Kingdom . |
| WO 89/01170 | 2/1989 | WIPO . |

*Primary Examiner*—Carl D. Friedman
*Assistant Examiner*—Dennis L. Dorsey
*Attorney, Agent, or Firm*—Killworth, Gottman, Hagan & Schaeff, L.L.P.

[57] ABSTRACT

A building product has an exposed surface provided by a multiplicity of linearly extending parallel asymmetric depressions of saw tooth configuration. Thus, a coloured exposed surface appearance apparently changes colour as relative positions of the building product and viewer change.

47 Claims, 3 Drawing Sheets

FIG.6
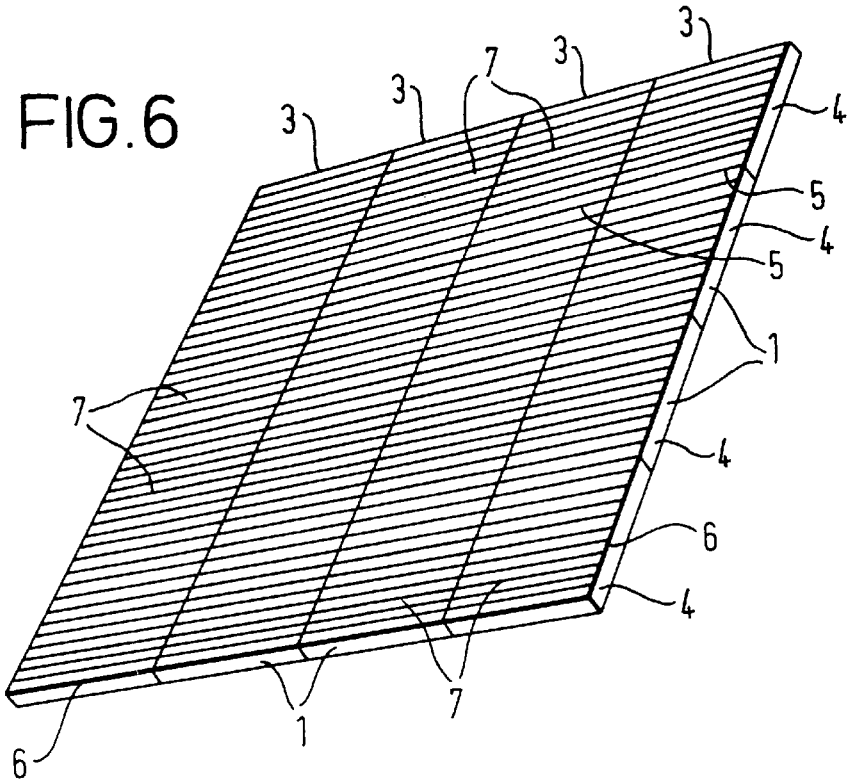
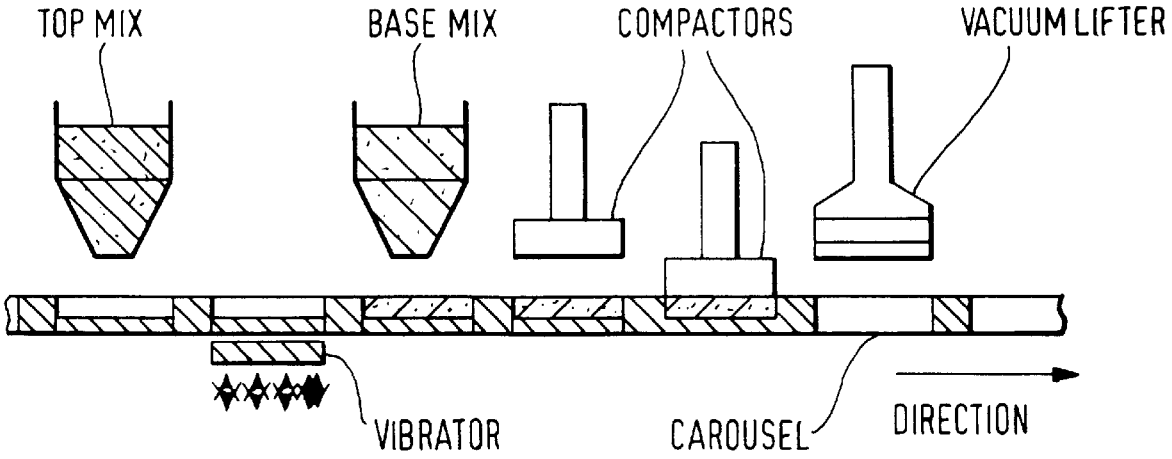
FIG. 7

BUILDING MATERIALS

This invention relates to building materials and more particularly to products used in and for the building, construction wad civil and structural engineering industries, such as masonry, paving, paving flags, paviours, flagstones, blocks, bricks, tiles, slates, posts, lintels, sills, slabs and panels and claddings and linings for walls, ceilings, roofs and floors. Hereinafter such products will generically be referred to as "building products".

There are many known ways of providing such building products with desired colours and the colour ranges which can be achieved nowadays are wide ranging and attractive. It is well known to use pigments in the materials from which the products are formed and/or glazings and/or surface finishes during forming and on the formed building products. With for example concrete building products, the pigment(s) may be added to the cementitious mix of water, cement, aggregate, filler, etc. and/or a surface finish provided during formation, eg in the mould or during a pressing or extrusion operation or to the formed product in the green or dry state. The aggregates used may also provide the "colour" instead of using pigment. The surface finish may be provided by paint or a finishing operation such as shot blasting, sand blasting, grinding, polishing, splitting, ground facing and combinations thereof to provide an attractive exposed surface appearance.

Any colouring agent in the mix whether it be pigment, aggregate, etc., gives the building product what is called "body colour" as opposed to "finishing" colour provided by paint or other finishing materials applied to the exposed surface of the formed product. In cases where there are no pigments, coloured aggregates or surface paints used, the exposed surface appearance of the building product is a "natural" colour resulting from the base materials used. This natural colour can be an overall grey with building materials made of concrete. In this specification the term "colour" is used in its broadest sense generically to cover black and white as well as grey.

Hitherto, any colour changes to a particular building product have been provided using different base materials, kinds of base materials (eg complementary or contrasting aggregates), coloured pigments or blends of pigments in the mix or by different coloured surface paints. If a particular customer, eg an architect or specifier, requires a building product having a coloured exposed surface appearance for a specific job, eg paving flags or paviours for a patio, the customer must choose from the range of colours which are available from the manufacturer and which may be further dictated by what is in stock at the time. Whilst this is not generally a problem, eg when the patio is being laid with paving flags of the same colour, it can be more problematical when the customer wants to use paving flags of several different colours to produce an individualised matching blend of colours. To satisfy this requirement by increasing the range of available colours of any one or more building products using existing techniques of changes in aggregates, pigments and/or surface paints is just not commercially viable. So the customer is restricted to the range of available colours that have been tried and tested but may not be to its liking.

Accordingly, it is an object of this invention to provide a building product having a coloured exposed surface appearance in which the aforesaid disadvantages are reduced or overcome.

To this end, and from one aspect, the present invention comprises a building product having an exposed surface appearance of which apparent colour changes can occur without changing any of the constituent materials of the building products.

Expressed in another way, the present invention comprises a building product having a coloured exposed surface appearance which apparently changes colour as the relative positions of the building product and viewer change.

By means of the invention, the existing range of coloured exposed surfaced building products is supplemented and the number of colour blends and combinations is increased many fold and all this is achieved without physically increasing the number of different colour surfaced building products.

The change of position may involve turning of the building product in a plane that is substantially parallel to a plane containing the exposed surface. For example with a four-sided paving flag having a substantially flat exposed surface which is laid side by side with other such paving flags, a turn through 90° will produce one apparent colour change, a second turn through 180° will produce a second apparent colour change and a turn through 270° will produce a third apparent colour change thereby providing a four-colour laid array of paving flags.

By way of another example, say in the case of a building product constituted by a rectangular building block used in walling, there may be one only apparent colour change which would be produced by tuning the block through 180°.

In one preferred way of carrying the invention into effect, a building product is provided with a surface finish that gives rise to the apparent colour change.

The surface finish may be achieved in any suitable way which is consistent with producing the apparent colour change of the surface appearance, for example during forming of the building product, eg by moulding, pressing or extrusion or any of shot blasting, sand blasting, grinding, polishing, splitting and ground facing of the formed building product in the green or dry state and combinations thereof.

In a preferred embodiment and one which has undergone successful trials and tests, the surface finish is provided by a multiplicity of linearly extending parallel asymmetric depressions.

Applicants have found that asymmetric depressions of saw tooth configuration are particularly advantageous.

In one formation, the saw tooth depressions have oppositely facing longitudinally extending side walls of which one side wall is of greater width and lesser inclination than the width and inclination of the other side wall.

An added advantage of an asymmetric saw tooth surface finish is that it provides surprisingly effective anti-skid characteristics on the exposed surfaces of paving flags and other building products used to cover floor and ground surfaces.

The depressions may have any suitable dimensions consistent with achieving the apparent colour changes. For example, the side walls may merge into each other at the deepest location of the depression through an arcuate corner portion having a radius of about 0.6 mm and at an angle of typically 60° to 130° and preferably any angle between and including 80° to 100°. At the open top of each depression, the side walls may terminate in respective curved side edges which define a flat ridge extending between the depressions. The depressions may each have a depth of any value between and including 0.2 mm to 5.0 mm but preferably any value between and including 1.9 mm to 2.1 mm and a width of any value between and including 1.0 mm to 20.0 mm and preferably any value between and including 6.9 mm to 7.1 mm.

The invention also comprises a method of manufacturing a building product with a coloured exposed surface, in which said coloured exposed surface is capable of apparent colour changes as the relative positions of the building product and viewer change.

The method may involve any of the forming and surface finishing operations described hereinabove but grinding of the exposed surface of the building product, preferably in the cured state when made of a cementitious material such as concrete, has been found by the applicants to produce the desired effect.

From a further aspect, the present invention comprises a laid array of building products having any of the coloured exposed surfaces defined hereinabove, in accordance with the invention, wherein the exposed surfaces of different building products of the array are apparently of different colours whatever the angle at which the building products are viewed.

In a modification, the entire laid array is of one colour when viewed from one angle and the entire array appears to change to another colour when the angle of view is changed.

In such arrays, there can be at least two apparent colour changes and more depending upon the number of sides. For example, in paving flags with four sides and hexagonal paving flags there can be four and six apparent colour changes respectively. On the other hand, with rectangular building blocks such as are used in walls, two such apparent colour changes only may be possible.

Expressed in another way, the invention comprises a laid array of building products, having any of the coloured exposed surfaces defined hereinabove, in accordance with the invention, such as paving flags, in which in at least one building product of the array is laid in a different direction to that in which the building products of the array were manufactured in production to provide an apparent colour change in said at least one building product.

order that the invention may be more readily understood, reference will now be made to the accompanying drawings, in which:

FIG. 1 is a plan view of a building product in the form of a paving flag and made in accordance with the invention;

FIG. 2. is a cross-section, to a greatly enlarged scale, through a portion of the exposed surface of the paving flag of FIG. 1;

FIG. 6 is a perspective view of another embodiment of a laid array of paving flags of FIGS. 1 and 2; and FIG. 7 is a schematic view of a typical hermetic paver plant suitable for making the paving flag of FIGS. 1 and 2.

Figure 1:
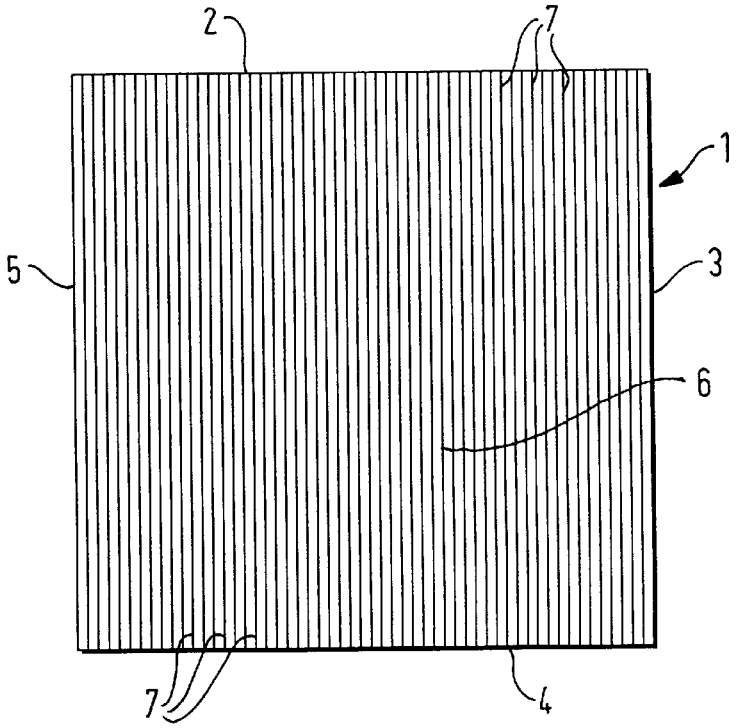
Figure 2:
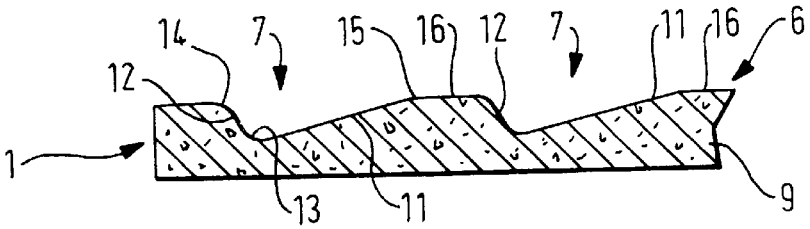

In FIGS. 1 and 2 there is shown a paving flag which is generally indicated at 1 and which is conveniently manufactured of a cementitious material such as concrete by a plant which is illustrated schematically in FIG. 7.

Paving flags and paviours have been made for many years using pressing processes. Where it is important that the paving flag has a tight texture on its exposed (visible) or uppermost, in use, surface a preferred method of manufacture is that known as the hermetic process. In this process two concrete mixtures are employed. The first concrete mixture has a high water content and consequently a high flow characteristic. The second concrete mixture contains a low water content and is generally referred to as having "zero slump". Where decorative products are being made, it is usual to employ specific aggregates to impart the desired colour or texture effect in the wetter mix which generally forms the layer which presents the exposed surface. The drier mix is usually designed to impart strength into the product, aesthetics being unimportant since the layer forms the underlayer which is not visible in use.

The manufacturing process involves a mould frame which is retractible. A pallet or carrier plate is clamped to the mould frame which then passes under the first operational station where a measured quantity of the first, flowable concrete mixture designated "Top Mix" is dosed into the bottom sealed mould fire. The mould frame then passes to a second station designated "Vibrator" where vibration is applied to level the wet concrete across the entire sealed mould frame. It then passes to a further station where a controlled amount of the under (second) layer of "zero slump" concrete designated "Base Mix" is dosed on top of the levelled first layer, the action of this doser ensuring that the second layer is also level across the mould frame.

It then, optionally, passes to a further station (not illustrated) where the two layers are pre-pressed before moving on to a further station designated "Compactors" where the concretes are pressed under high pressure and, optionally, vibration. This action ensures the formation of a good bond between the two concrete layers in that water migrates under the pressure applied from the lower wetter layer into the upper drier layer. The lower layer being more flowable is also pressed into a smooth finish whereas the upper layer may contain some degree of voidage.

The process is completed by the fully filled and pressed mould frame passing to a final station designated "Carousel" where the uncured product is ejected and transferred utilising the designated "Vacuum lifter" to a further carrier and thence to a curing area. Following curing, the paving flags are removed from their carriers and packaged. Where special surface effects are desired, surface finishing is accomplished between their removal from the curing stage carriers and packaging. All stages are sequential and are in continuous flow scenarios to ensure optimum efficiency.

There other options in existence for manufacturing these paving products. For example two relatively dry mixes may be used in similar equipment as described or a single mix may be used. Another alternative is to make a single wet flowable mix and use pressing equipment that effects de-watering of the pressed product during manufacture. In the simplest form of manufacture, plastic or other mould forms may be filled by hand with a flowable concrete, vibrated, allowed to cure, and then de-moulded.

Figure 3:
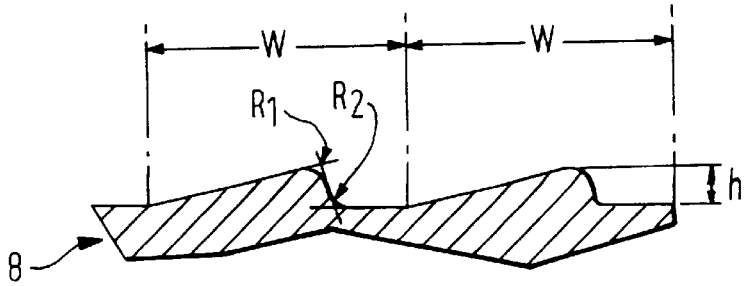
FIG. 3 is a cross-section, to a greatly enlarged scale, through a portion of a tool for surface finishing the exposed surface of the paving flag of FIG. 1.

Referring more particularly to FIGS. 1 and 2, the paving flag 1 is of square configuration, (typically 300 mm by 300 mm or 450 mm by 450 mm) with its four sides being designated by the reference characters 2, 3, 4 and 5 and its exposed surface which is the uppermost in use by the reference character 6. The exposed surface 6 is provided with a surface finish which appears in the plan view of FIG. 1 to be a series of parallel strips extending between the sides 2 and 4 but which are, in fact, linearly extending parallel depressions 7 in the surface 6. In the illustrated embodiment, these depressions 7 are formed by a grinding action of the tool 8 of FIG. 3 which shows a greatly magnified part of a grinding roller to which the exposed surfaces of a succession of the paving flags 1 are presented in the cured state.

Referring now to FIG. 2, there can be seen the cross-hatched portion which is the body 9 of the paving flag 1 and two depressions 7 each of asymmetric saw tooth configuration. Each depression 7 has oppositely facing longitudinally extending side walls 11 and 12 of which one side wall 11 is of greater width and lesser inclination than the other side wall 12. The side walls 11 and 12 merge into each other at the deepest location of the depression 7 through an arcuate corner portion 13 having a radius $R_1$ which is typically about 0.6 mm and at an angle of typically 60° to 130°. At the open top of the depression 7, the side walls 11 and 12 terminate in respective curved side edges 14, 15 of which the side edge 15 has a radius $R_2$ of about 0.6 mm. The edges 14 and 15 define a flat ridge 16 extending between the depressions 7, with the flat ridges 16 appearing as black lines. The dimensions of the depressions will be apparent from FIG. 3 which show a maximum depression depth h of about 1.9 mm to 2.1 mm and a maximum width W at the top of about 6.9 mm to 7.1 mm.

Figure 4:
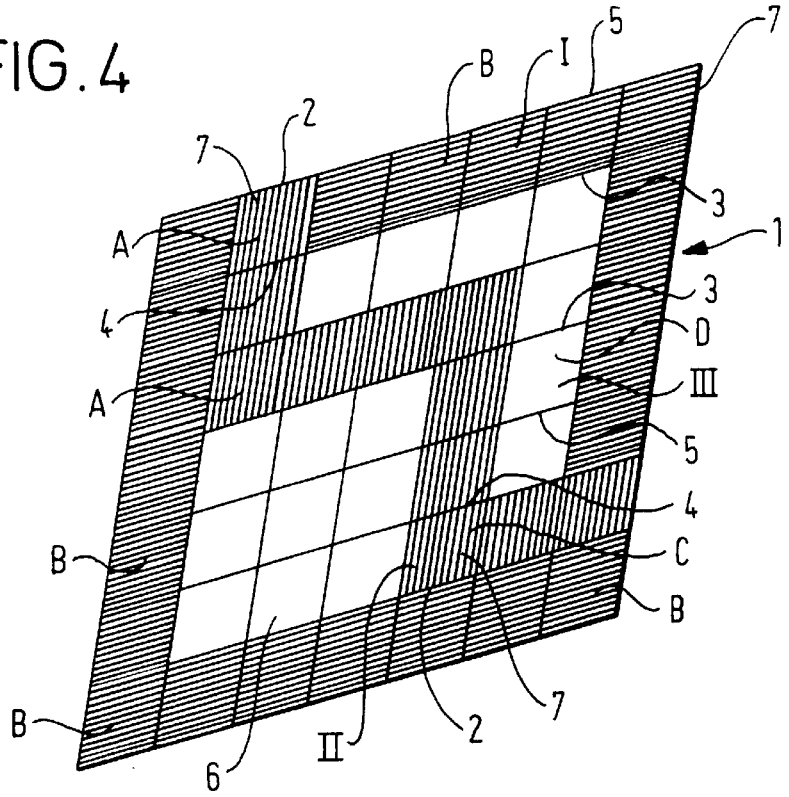
FIG. 4 is a diagrammatic perspective view of one embodiment of a laid array of paving flags of FIGS. 1 and 2, providing four apparently different exposed coloured surfaces.

In FIG. 4, a multiplicity of paving flags 1 are shown laid in three additional directions to that in which the paving flags were manufactured to provide three apparent colour changes with the original colour. Thus, the paving flags identified by the reference A are those paving flags which have been laid in the same direction to that in which the paving flags were manufactured, ie with direction of the depressions 7 extending between the top and bottom sides 2 and 4 as illustrated and exhibit the body colour of the paving flags. By turning a plurality of paving flags 1 identified by the reference B in the clockwise direction I through 90° and in a plane containing the plane of the exposed surface 6 so that the depressions 7 lie at right angles to those of paving flags A a first apparent colour change occurs. Others C of the paving flags 1 are turned in a second clockwise direction II through 180° in relation to the paving flags A, as illustrated, so that the depressions 7 extend parallel to those of paving flags A but 180° in the opposite direction to exhibit a second apparent colour change. Finally, those D of paving flags 1 are turned through 270° in a clockwise direction III, as illustrated, in which the depressions 7 disappear from view but in fact extend parallel to those of paving flags B but 180° in the opposite direction to exhibit a third apparent colour change.

Figure 5:
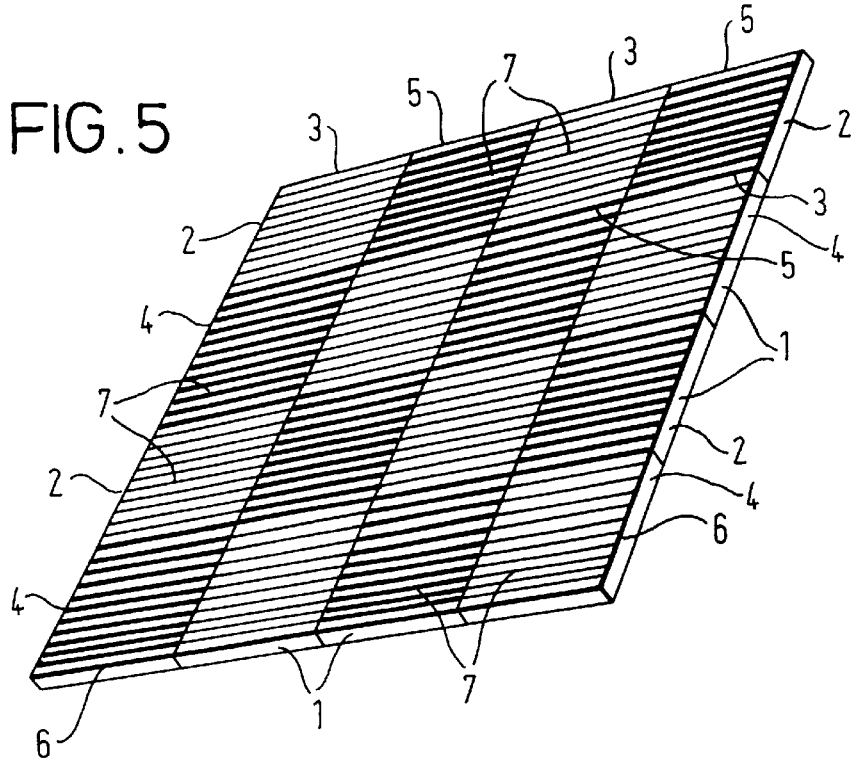
FIG. 5 is a perspective view of another embodiment of a laid array of paving flags of FIGS. 1 and 2.

The paving flags 1 of the laid array of FIG. 5 have every second flag turned at 180° relative to the neighbouring one. Thus, the array produces a checkerboard pattern when viewed from direction of the sides of the array. The checkerboard pattern changes the colours when viewed from the four different sides of the array.

The paving flags 1 of the laid array of FIG. 6 are all laid in the same direction with regard to colour when viewed from direction of the sides of the array and provide four apparently different exposed coloured surfaces for the entire array when viewed from the four different sides of the array respectively. Of course, if the laid array was located in a corner so as to be viewable from two directions only, then two colours only would be visible in total, ie one colour from each direction.

Although the embodiments described with reference to the drawings relate to paving flags, it will be appreciated that the invention is applicable to all manner of building products with exposed surfaces, eg masonry products and building blocks for walls where it is desired to provide a wide variety of aesthetically pleasing colour effects from an existing range of building products. Embodiments are envisaged in which the depressions are not asymmetric nor of saw tooth configuration. Instead of being square, the building products may be of any other shape appropriate to the intended purpose, eg oblong and polygonal products having more than four sides. Moreover, the described surface finishing of asymmetric depressions could be replaced by any other suitable surface finish consistent with providing apparent colour changes on change of position and/or angle of view. Furthermore, whilst concrete has been used for the material of the described embodiment, any suitable materials from a wide range of material inputs, for example clay, may be used.

What is claimed is:

1. A building product having an exposed surface provided by a multiplicity of linearly extending parallel asymmetric depressions of saw tooth configuration having oppositely facing longitudinally extending side walls of which one side wall is of greater width and lesser inclination than the width and inclination of the other side wall, whereby an inherently coloured exposed surface appearance apparently changes colour as relative positions of the building product and viewer change and the apparent color change occurs without changing any of the constituent materials of the building product.

2. A building product as claimed in claim 1, wherein the change of position involves turning of the building product.

3. A building product as claimed in claim 2, wherein the change of position involves turning the building product in a plane that is substantially parallel to a plane containing the exposed surface.

4. A building product as claimed in claim 1 and of a generally rectangular shape with a substantially flat exposed surface with its four sides disposed at an angle of 90° C. to each other such that a turn through 90° will produce one apparent colour change, a turn through 180° will produce an apparent colour change and a turn through 270° will produce an apparent colour change.

5. A building product as claimed in claim 1, wherein the side walls of each depression merge into each other through an arcuate corner portion having a radius of about 0.6 mm and at an angle of 60° to 130°.

6. A building product as claimed in claim 5, wherein the said angle is any angle between and including 80° to 100°.

7. A building product as claimed in claim 1, wherein each depression has a depth of any value between and including 0.2 mm to 5.0 mm.

8. A building product as claimed in claim 7, wherein each depression has a depth of any value between and including 1.9 mm to 2.1 mm.

9. A building product as claimed in claim 1, wherein each depression has a width of any value between and including 1.0 mm to 20.0 mm.

10. A building product as claimed in claim 9, wherein each depression has a width of any value between and including 6.9 mm to 7.1 mm.

11. A building product as claimed in claim 1, wherein the asymmetric depressions provide the exposed surface with anti-skid characteristics which are effective when the product is used to cover a floor or ground surface.

12. A building product as claimed in claim 1 and in the form of a building or masonry block or walling, ground covering or floor forming product.

13. A building product as claimed in claim 1, and in form of a paving flag or ground covering or floor forming product.

14. A building product as claimed in claim 1 and made of a cementitious material.

15. A building product as claimed in claim 14 wherein the cementitious material is concrete.

16. A building product as claimed in claim 1 and made from an aggregate bound by a polymeric material.

17. A building product as claimed in claim 16 wherein the polymeric material is selected from polyester, polyurethane or epoxy resin.

18. A building product as claimed in claim 1 and made from clay.

19. A laid array of building products as claimed in claim 1, wherein the exposed surfaces of different building products of the array are apparently of different colours whatever the angle at which the building products are viewed.

20. A laid array of building products as claimed in claim 1, wherein the exposed surfaces of the entire array are of one colour when viewed from one angle and the entire array appears to change to another colour when the angle of view is changed.

21. A laid array of building products as claimed in claim 1, wherein, at least one building product of the array is laid in a different direction to that in which the building products of the array were manufactured in production to provide an apparent colour change in said at least one building product.

22. A method of manufacturing a building product, characterised by providing the building product with an exposed surface having a multiplicity of linearly extending parallel asymmetric depressions of saw tooth configuration having oppositely facing longitudinally extending side walls of which one side wall is of greater width and lesser inclination than the width and inclination of the other side walls, whereby an inherently coloured exposed surface appearance apparently changes colour as relative positions of the building product and viewer change and the apparent colour change occurs without changing any of the constituent materials of the building product.

23. A method as claimed in claim 22, wherein the change of position involves turning of the building product.

24. A method as claimed in claim 23, wherein the change of position involves turning the building product in a plane that is substantially parallel to a plane containing the exposed surface.

25. A method as claimed in claim 22 and further comprising providing the building product with a generally rectangular shape and a substantially flat exposed surface having four sides disposed at a angle of 90° to each other and wherein turning the building product through 90° produces an apparent colour change, turning the building product through 180° produces an apparent colour change and turning the building product through 270° produces an apparent colour change.

26. A method as claimed in claim 22, wherein the asymmetric depressions are formed with oppositely facing longitudinally extending side walls of which one side wall is of greater width and lesser inclination than the width and inclination of the other side wall.

27. A method as claimed in claim 26, wherein the side walls of each depression merge into each other at a deepest location of the depression through an arcuate corner portion having a radius of about 0.6 mm and at an angle of 60° to 130°.

28. A method as claimed in claim 27, wherein the said angle is any angle between and including 80° to 100°.

29. A method as claimed in claim 22, wherein each depression is formed with an open top at which the side walls terminate in respective curved side edges which define a flat ridge extending between the depressions.

30. A method as claimed in claim 22, wherein each depression is formed with a depth of any value between and including 0.2 mm to 5.0 mm.

31. A method as claimed in claim 30, wherein each depression is formed with a depth of any value between and including 1.9 mm to 2.1 mm.

32. A method as claimed in claim 22, wherein each depression is formed with a width of any value between and including 1.0 mm to 20.0 mm.

33. A method as claimed in claim 32, wherein each depression is formed with a width of any value between and including 6.9 mm to 7.1 mm.

34. A method as claimed in claim 22, wherein the asymmetric depressions are formed during forming of the building product.

35. A method as claimed in claim 34, comprising forming the asymmetric depressions by moulding, pressing or extrusion.

36. A method as claimed in claim 22, comprising forming the asymmetric depressions after forming of the building product, either in a green or cured state.

37. A method as claimed in claim 36, comprising forming the asymmetric depressions in the cured state by a grinding operation.

38. A method as claimed in claim 37, comprising presenting the exposed surfaces of a succession of building products to a grinding roller to form the asymmetric depressions.

39. A method as claimed in claim 22, wherein the asymmetric depressions provide the exposed surface with anti-skid characteristics which are effective when the product is used to cover a floor or ground surface.

40. A method as claimed in claim 22, comprising forming the building product as a building block, a masonry block or walling, ground covering or floor forming product.

41. A method as claimed in claim 22, comprising forming the building product as a paving flag or ground covering or floor forming product.

42. A method as claimed in claim 22, and comprising manufacturing the building product from a cementitious material.

43. A method as claimed in claim 42 wherein the cementitious material is concrete.

44. A method as claimed in claim 22 and made from an aggregate bound by a polymeric material.

45. A method as claimed in claim 44 wherein the polymeric material is selected from polyester, polyurethane, or epoxy resin.

46. A method as claimed in claim 22, and made from clay.

47. A building product having an exposed surface provided by a multiplicity of linearly extending parallel asymmetric depressions of saw tooth configuration having oppositely facing longitudinally extending side walls of which one side wall is of greater width and lesser inclination than the width and inclination of the other side wall, with the side walls of each depression merging into each other at a deepest location of the depression through an arcuate corner portion and where each depression has an open top at which the side walls terminate in respective curved side edges which define a flat ridge extending between the depressions, whereby an inherently coloured exposed surface appearance apparently changes colour as relative positions of the building product and viewer change and the apparent colour change occurs without change any of the constitutent materials of the building product.

* * * * *